US007277004B2

(12) United States Patent
Beck et al.

(10) Patent No.: US 7,277,004 B2
(45) Date of Patent: Oct. 2, 2007

(54) BI-DIRECTIONAL DEFLECTABLE RESISTOR

(75) Inventors: David B. Beck, West Jordan, UT (US); John A. Sindt, Sandy, UT (US); Thomas E. Danielson, Sandy, UT (US)

(73) Assignee: Sensitron, Inc., Draper, UT (US)

( * ) Notice: Subject to any disclaimer, the term of this patent is extended or adjusted under 35 U.S.C. 154(b) by 250 days.

(21) Appl. No.: 11/112,775

(22) Filed: Apr. 22, 2005

(65) Prior Publication Data

US 2006/0238291 A1 Oct. 26, 2006

(51) Int. Cl.
*H01C 7/10* (2006.01)
*H01C 7/13* (2006.01)

(52) U.S. Cl. ..... 338/22 R; 338/2; 600/587; 324/660

(58) Field of Classification Search ..... 338/2, 338/22 R, 47, 114; 600/587, 595; 361/278, 361/283.1; 324/660; 33/512
See application file for complete search history.

(56) References Cited

U.S. PATENT DOCUMENTS 3,124,769 A * 3/1964 Peterson ..... 338/2
3,991,745 A * 11/1976 Yoslow et al. ..... 600/594
4,152,748 A * 5/1979 Arkans ..... 600/592
4,444,205 A * 4/1984 Jackson ..... 338/114
5,086,785 A 2/1992 Gentile et al.
5,157,372 A 10/1992 Langford
5,309,135 A 5/1994 Langford
5,576,684 A 11/1996 Langford
5,583,476 A 12/1996 Langford
5,610,528 A * 3/1997 Neely et al. ..... 361/278

* cited by examiner

*Primary Examiner*—Richard K. Lee
(74) *Attorney, Agent, or Firm*—Holme Roberts & Owen LLP

(57) ABSTRACT

A system and method for a bi-directional deflectable resistor. The bi-directional deflectable resistor has a first layer of conductive material on a top surface of a substrate and a second layer of conductive material on a bottom surface of a substrate, each layer having a resistance that changes predictably when an electrical signal is applied thereto. The change of resistance of either the first layer of conductive material or the second layer of conductive material reflects an amount of deflection of the respective layer. Having two layers of conductive material allows for the measurement of deflection in all directions.

26 Claims, 7 Drawing Sheets

BI-DIRECTIONAL DEFLECTABLE RESISTOR

BACKGROUND OF THE INVENTION

1. The Field of the Invention

This invention relates to electrical components and more particularly to deflectable resistors which vary in electrical resistance.

2. The Relevant Technology

Potentiometers are standard elements of electrical and electronic circuits. They are widely in use today for a variety of purposes including the measurement of mechanical movement. Even though potentiometers are presently available, for example U.S. Pat. No. 5,157,372 (Langford) and U.S. Pat. No. 5,583,476 (Langford), which are incorporated herein for all purposes, no bi-directional deflectable resistor is known to applicant that produces a consistent and predictable variable electrical output upon deflection or bending between configurations occurring in opposite directions from a static configuration.

The use of electrically conductive inks in association with electrical or electronic circuitry is also known. For example, U.S. Pat. No. 4,649,748 (Fulks, et al.) discloses the use of a conductive ink which is pressure sensitive to produce electrical switching signals for a keyboard. However, as stated previously, no bi-directional flexible or deflectable resistor is known which uses electrically conductive or resistive ink.

BRIEF SUMMARY OF THE INVENTION

In various exemplary embodiments of the present invention, a bi-directional deflectable resistor is provided. In general, the deflectable resistor comprises a substrate, a first layer of conductive material and a second layer of conductive material. The substrate has a top surface and a bottom surface and a first configuration. In operation, the substrate bends from a first configuration to a second configuration in a direction that is generally downward and away from relative to said top surface. The substrate also bends from a first configuration to a third configuration in a direction that is generally upward and away from relative to said bottom surface and opposite to said direction upward and away from relative to said top surface.

The first layer of conductive material is disposed on said top surface of the substrate. The first layer of conductive material has a resistance that changes predictably when the resistor is bent from the first configuration and an electrical signal is applied thereto. In general, the change of resistance of the first layer of conductive material reflects the amount of deflection between the first configuration and the second configuration. The second layer of conductive material is disposed on the bottom surface of the substrate. The second layer of conductive material has a resistance that also changes predictably when the resistor is bent from the first configuration and an electrical signal is applied thereto. The change of resistance of the second layer of conductive material reflects the amount of deflection between said first configuration and the third configuration.

In operation, the bending of the first layer of conductive material between the first configuration and the second configuration causes a number of micro-cracks that are added during the manufacturing process to open up and separate in the first layer of conductive material. As the amount of bending to the second configuration increases, the size of the micro-cracks (i.e., the distance between the conductive materials) in the first layer of conductive material increases and the resistance, therefore, also increases. Similarly, the bending of said second layer of conductive material between the first configuration and the third configuration causes a number of micro-cracks that are added during the manufacturing process to open up and separate in said second layer of conductive material. As the amount of bending to the third configuration increases, the size of the micro-cracks in the second layer of conductive material increases and the resistance, therefore, also increases.

In another embodiment, the substrate has a top surface and a bottom surface. The substrate bends in a first direction downward and away from relative to said top surface and in a second direction upward and away from relative to said bottom surface and opposite said first direction. A first layer of electrically conductive ink is disposed on said top surface of said substrate. The first layer of resistive ink has a resistance that changes predictably when the resistor bends in the first direction and an electrical signal is applied thereto. The change of resistance of the first layer of resistive ink reflects the amount of deflection in the first direction. A second layer of resistive ink is disposed on the bottom surface of the substrate. The second layer of electrically conductive ink has a resistance that changes predictably when the resistor bends in the second direction and an electrical signal is applied thereto. The change of resistance of the second layer of electrically conductive ink reflects the amount of deflection in the second direction.

In still another embodiment, the substrate has a length with a longitudinal y-axis running along said length. The first direction of bending is in a positive x-direction relative to the longitudinal y-axis and the second direction of bending is in a negative x-direction relative to the longitudinal y-axis.

In another embodiment, the deflectable resistor desirably includes a first and second segmented conductor. The first segmented conductor is positioned on a first layer of electrically conductive ink and is formed of an electrically conductive material deposited on the first layer of electrically conductive ink in spaced apart segments. The second segmented conductor is positioned on a second layer of electrically conductive ink and is formed of an electrically conductive material deposited on the second layer of electrically conductive ink in spaced apart segments.

In yet another embodiment, the first configuration of a substrate is a static configuration. Preferably, the static condition of the substrate may be a substantially flat substrate or one where said substrate has at least one bend.

In still another embodiment, a first connector means is coupled to a first layer of conductive material for interconnection to external electrical components and a second connector means is coupled to a second layer of conductive material for interconnection to external electrical components.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DESCRIPTION OF A PREFERRED EMBODIMENT

Figure 1:
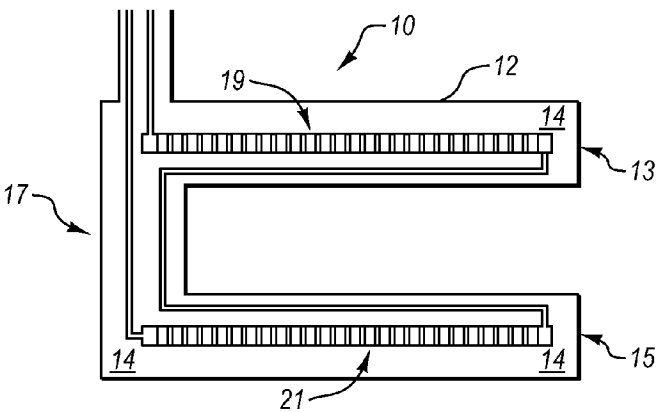
FIG. 1 illustrates a top view of a deflectable resistor in accordance with the present invention.

FIG. 1 illustrates a top view of a bi-directional deflectable resistor 10. Bi-directional deflectable resistor 10 comprises a substrate 12 that is double sided, thereby having both a top surface 14 and a bottom surface 50 (shown in FIG. 3). In the illustrated example, substrate 12 has a first length 13 and a second length 15 and a third length 17. Third length 17 connects the first length 13 with the second length 15 to form a U-shaped bi-directional deflectable resistor 10. The top surface 14 of first length 13 has a layer of variable resistance or conductible material 19 disposed thereon and the top surface 14 of second length 15 has a layer of variable resistance or conductible material 21 disposed thereon.

Figure 3:
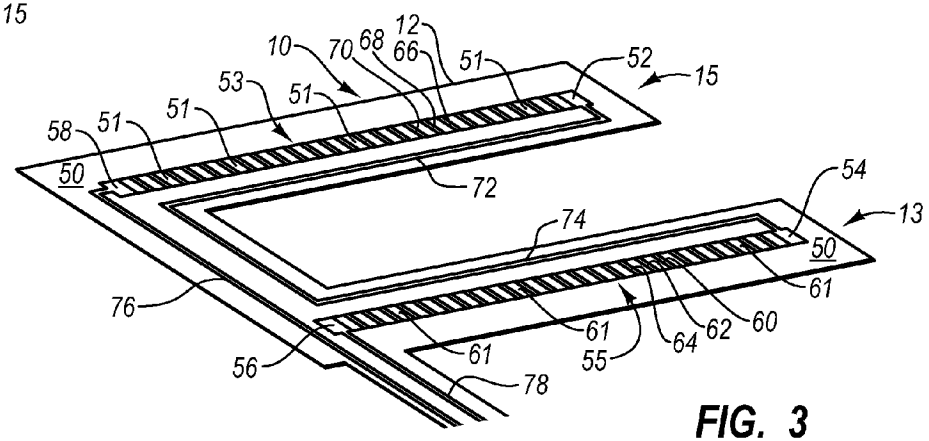
FIG. 3 illustrates a bottom perspective view of the deflectable resistor shown in FIG. 1.

The bottom surface 50, shown in FIG. 3, is essentially a mirror image of top surface 14 and will be described in greater detail herein with respect to FIG. 3. As such, any explanation of materials, dimensions, etc. that are described with respect to the top surface 14, applies equally to bottom surface 50.

Substrate 12 is formed of a deflectable insulating material. Various types of phenolic resin materials are presently believed to be suitable as the substrate. The substrate may also be constructed of various materials including various polymers, such as polyamide, polyimide (Kapton), and polyester (Mylar), which may be thermoplastics.

For applications involving multiple bending movements, a phenolic resin has been found to be particularly suitable. However, other materials may be suitable in selected applications. For example, the deflectable resistor may be used to measure inelastic deformation so that the substrate itself is inelastically deformable. Preferably, the substrate 12 should be deflectable without causing an electrical discontinuity or open circuit in the conductor means while generally maintaining its electrical insulating characteristics.

The conductible material 19, 21 may be a two-part epoxy material, a thermoset adhesive, or a thermoplastic, all incorporating conductive material such as graphite or carbon. The variable resistance material may include a carbon ruthenium. To attach to a substrate, the conductible material 19, 21 may include a material which facilitates wetting, gluing, or sticking. The conductible material 19, 21 may include graphite in combination with a binder. The conductible material 19, 21 is preferably of the type which is applied to the substrate in liquid form and which in turn dries to a solid form.

Merely examples, the substrate 12 may be from about 0.003 to about 0.007 inches in thickness (although various other thicknesses may be acceptable); the variable resistive material 19, 21 may be from about 0.0006 to about 0.0011 inches in thickness (although various other thicknesses may be acceptable).

Bi-directional deflectable resistor 10 may be used to measure a degree or angle of deflection. The greater the amount of the deflection, the greater the resistance of conductible material 19, 21. With measurements, a relationship between the degree or angle of deflection of substrate 12 and the resistance of conductible material 19, 21 can be developed and used in software that is relatively simple to create.

Figure 2:
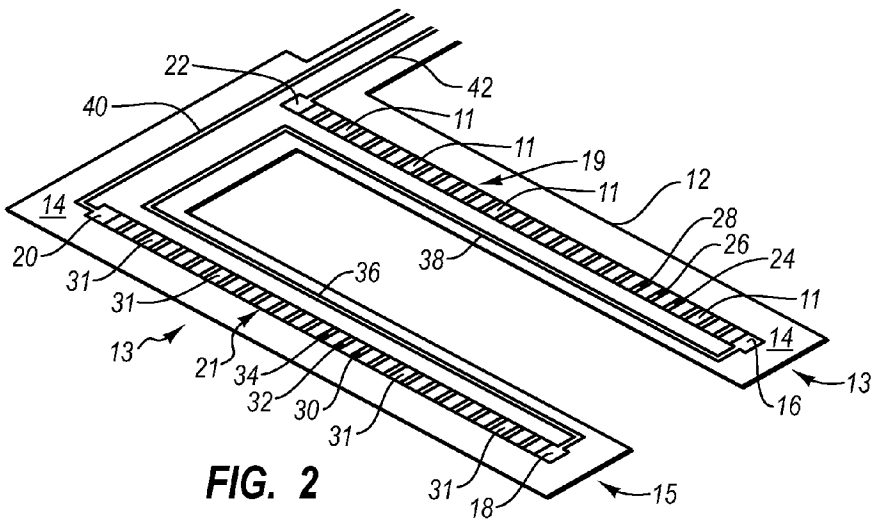
FIG. 2 illustrates a top perspective view of the deflectable resistor depicted in FIG. 1.

FIG. 2 illustrates a top perspective view of bi-directional deflectable resistor 10 in accordance with one aspect of the present invention. The top of bi-directional deflectable resistor comprises a first top layer of electrically conductive or resistive ink 11 and a second top layer of electrically conductive or resistive ink 31 disposed on the top surface 14 of substrate 12. Both the first top layer of resistive ink 11 and the second top layer of resistive ink 31 have a segmented conductor layer disposed thereon. In the illustrated embodiment, the segmented conductor layer of conductive layer 19 comprises a number of segmented conductors 24, 26, 28 and end segmented conductors 16, 22. Similarly, the segmented conductor layer of conductive layer 21 comprises a number of segmented conductors 30, 32, 34 and end segmented conductors 18, 20.

The first top layer of electrically conductive ink 11 and a second top layer of electrically conductive ink 31 are interconnected by segmented conductor runs 36, 38. In this manner, the resistance of conductive layer 19 and conductive layer 21 are connected and can be measured together. To facilitate the measurement of the resistance of conductive layer 19 and conductive layer 21, segmented conductor run 40 is electrically connected to the end segmented conductor 20 and segmented conductor run 42 is electrically connected to the end segmented conductor 22. Segmented conductor runs 40, 42 would be electrically connected to a suitable connector means for interconnection to external electrical components.

FIG. 3 illustrates a bottom perspective view of bi-directional deflectable resistor 10 in accordance with another aspect of the present invention. As illustrated, the bottom of deflectable resistor 10 is essentially a mirror image of the top. The bottom of bi-directional deflectable resistor comprises a first bottom layer of electrically conductive ink 51 and a second bottom layer of electrically conductive ink 61 disposed on the bottom surface 50 of substrate 12. Both the first bottom layer of electrically conductive ink 51 and the second bottom layer of electrically conductive ink 61 have a segmented conductor layer disposed thereon. In the illustrated embodiment, the segmented conductor layer of conductive layer 53 comprises a number of segmented conductors 66, 68, 70 and end segmented conductors 52, 58. Similarly, the segmented conductor layer of conductive layer 55 comprises a number of segmented conductors 60, 62, 64 and end segmented conductors 54, 56.

The first bottom layer of electrically conductive ink 51 and the second bottom layer of electrically conductive ink 61 are interconnected by segmented conductor runs 72, 74. In this manner, the resistance of conductive layer 51 and conductive layer 61 are connected and can be measured together. To facilitate the measurement of the resistance of conductive layer 51 and conductive layer 61, segmented conductor run 76 is electrically connected to the end segmented conductor 58 and segmented conductor run 78 is electrically connected to the end segmented conductor 56. Segmented conductor runs 76, 78 would be electrically connected to a suitable connector means for interconnection to external electrical components.

Segmented constant resistance conductive material, although not necessary, may be used in combination with bi-directional deflectable resistor 10 to reduce the resistance and help linearize changes in resistance. The segmented conductors may be made of silver, silver alloys, or other conductive metals, as well as conductive carbon-based compounds. The segmented conductors may be applied in a liquid form, or applied in a solid form which is pressed onto the variable resistance material. The conductivity of the segmented conductors remains essentially constant upon deflection. Therefore, the segmented conductors provide paths for electrical current that are in parallel with the path provided by the variable resistance material 19, 21. The segmented conductors act as attenuators and reduce the overall resistance of the conductive material. It is also believed but not proven that the segmented conductors may help to make the resistance versus load curve of a flexible potentiometer more linear. The segmented conductors may also help make the resistance at a particular deflection configuration more consistently repetitive.

The variable resistance material 19, 21 may be spray painted, rolled, silk screened, or otherwise printed onto the substrate. The variable resistance material may be a solid which is pressed onto the substrate. A conductive substrate may be used. The substrate may be connected to a particular potential, such as ground. A non-conductive coating may be applied to the substrate.

It should be appreciated that the while illustrated embodiment illustrated in FIGS. 1-3 depicts a U-shaped substrate 12 with a layer of conductive material 19 on the top surface 14 of the first length 13 and a layer of conductive material 21 on the top surface of the second length 15, any number of lengths may be used. For example, bi-directional deflective resistor 10 may comprise a single leg 13 having a single layer of conductive material 19 disposed on the top surface 14. In this manner, the segmented conductor run 38 would join with the segmented conductor run 40. Similarly, bi-directional deflective resistor 10 may have three or more lengths each having a layer of conductive material disposed thereon, with each of the layers of conductive material joined together by a run of conductive material.

Figure 4:
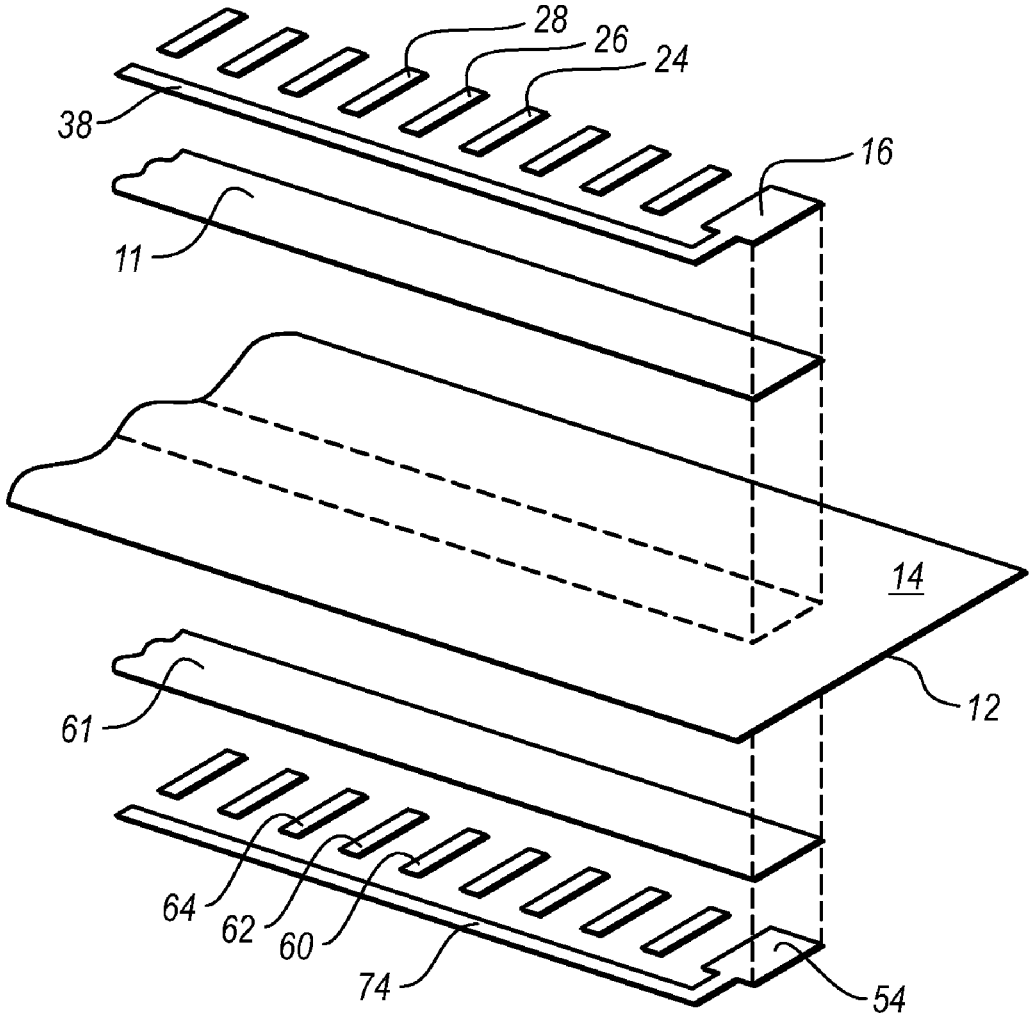
FIG. 4 illustrates an exploded view of a portion of the substrate, a portion of the first and second layer of conductive material and a portion of the first and second segmented conductor.

FIG. 4 illustrates an exploded view of a portion of the length 13 of substrate 12. As illustrated, a portion of the first layer of conductive material 11 that is disposed on the top surface 14 and a portion of the second layer of conductive material 61 that is disposed on the bottom surface 50 (not shown) is illustrated as suspended below the substrate 12. The first segmented conductor having segment 24, 26, 28, end segment 16 and conductive material run 38 is shown suspended above the layer of conductive material 11. Similarly, the second segmented conductor having conductor segments 60, 62, 64, end conductor segment 54 and conductor segment run 74 is shown suspended below the layer of conductive material 61.

Figure 5:
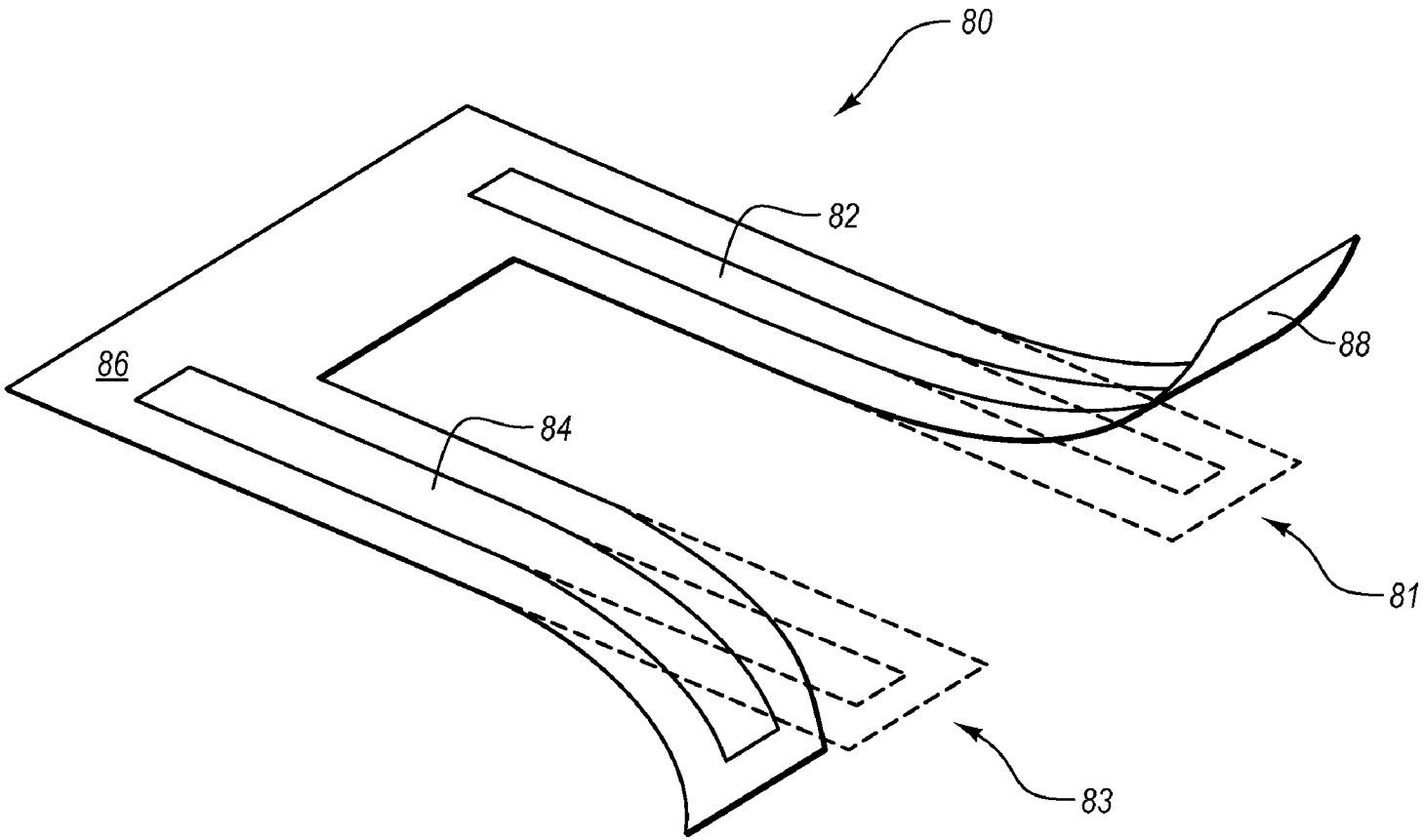
FIG. 5 illustrates a top perspective view of a substrate and a first and second layer of conductive material disposed thereon illustrating a portion of the substrate deflected in a first direction and a second portion of the substrate deflected in a second direction, opposite to the first direction.

Referring now to FIG. 5, a substrate 80 is shown having a first length 81 deflecting in a first direction and a second length 83 deflecting in a second direction that is opposite to the first direction. First length 81 has a first top layer of conductive material 82 disposed on the top surface 86. Second length 83 has a second top layer of conductive material 84 disposed on the top surface 86. The bottom surface 88 of first length 81 and second length 83 has a first and second bottom layer of conductive material (not illustrated) disposed thereon.

In operation, when first length 81 deflects in the first direction, the resistance of the first top layer of conductive material 82 predictably changes. The measurement of the change of resistance of the first top layer of conductive material reflects the amount of deflection. Similarly, when the second length 83 deflects in the second direction, the resistance of the second bottom layer of conductive material (not shown) predictably changes. The measurement of the change of resistance of the second bottom layer of conductive material (not shown) reflects the amount of deflection. This operation will be described in greater detail hereinafter.

Continuing with the operation of deflectable resistor 10, micro-cracks (not shown) are added to the variable resistance material during the manufacturing process. It is believed but not known that as a deflectable resistor (of some or all compositions), is deflected or bent, the distance between the micro-cracks of the variable resistance material separates or widens. That is, in some or all compositions, dried variable resistance material has micro-cracks in a granular or crystalline-type structure which widens and separates upon deflection. As the variable resistance material deflects, the number of cracks and the space between them is believed to increase, thereby changing the electrical resistance in a predictable manner. When the resistor 10 is bent, the change can then be measured upon application of suitable electrical signals.

Figure 6:
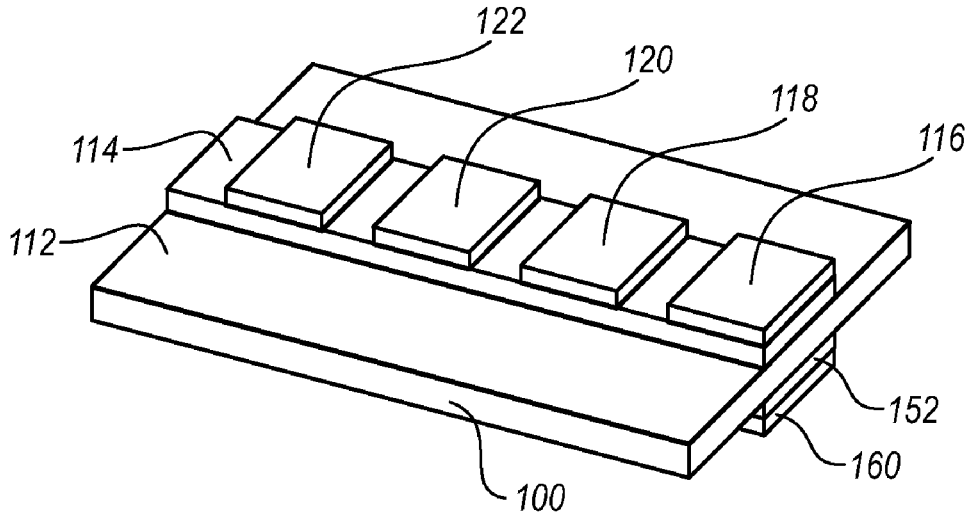
FIG. 6 illustrates an enlarged perspective view of a portion of the top of a deflectable resistor of the present invention.

The top view of a portion of a deflectable resistor of FIG. 6 is shown in perspective and substantially enlarged view. Conductor means 114 is adhered to the top surface 112 of substrate 100. The deflectable resistor includes a segmented conductor adhered to the conductor means 114. The segmented conductor is formed of an electrically conductive material in segments 116, 118, 120, 122 each spaced from the other along the conductor means 114.

Figure 7:
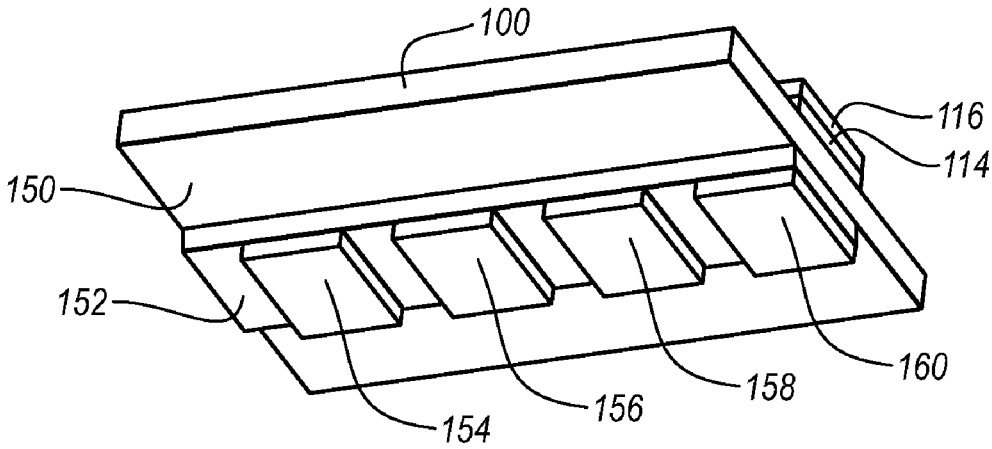
FIG. 7 illustrates an enlarged perspective view of a portion of the bottom of a deflectable resistor of the present invention.

The bottom view of a portion of a deflectable resistor of FIG. 7 is also shown in perspective and substantially enlarged view. Conductor means 152 is adhered to the top surface 150 of substrate 100. The deflectable resistor includes a segmented conductor adhered to the conductor means 152. The segmented conductor is formed of an electrically conductive material in segments 154, 156, 158, 160 each spaced from the other along the conductor means 152.

Referring to FIGS. 6 and 7, the substrate 100 is shown to have a thickness which is here shown substantially disproportionate to the true thickness of the substrate solely to facilitate illustration. That is, for the substrate 100 to be elastically deflectable, it is preferred that its thickness be from about 0.076 to about 0.229 millimeters. If it is to be inelastically deflectable, the material and thickness must be appropriately selected.

The conductor means 114, 152 of FIGS. 6 and 7 are typically a conductive or resistive ink that is adhered to the substrate 100. By adhere, it is meant that the conductive ink is attached to the substrate because the conductive ink includes a material that facilitates wetting, gluing, or sticking. A conductive ink suitable for the illustrated embodiment is available from Flexpoint Sensor Systems, Inc., 106 west 12200 south, Draper, Utah 84020 and identified as part number 365 or DOH 10 or variations on this ink formulation. The selected ink includes graphite in combination with a binder.

As illustrated in FIGS. 6 and 7, the conductive ink 114, 152 is deposited to adhere to the substrate 100 and in turn has a thickness which is here illustrated substantially larger than the actual thickness. That is, the thickness of the layer of conductive ink 114, 152 is illustrated disproportionate to the actual thickness of the substrate and of the actual layer of the conductive ink 114, 152. In particular the thickness of the conductive ink 114, 152 is from about 0.01 millimeters to 0.03 millimeter and desirably about 0.02 millimeters.

As illustrated in FIGS. 6 and 7, the top surface 112 has a segmented conductor having segmented conductor segments 116, 118, 120, 122 that may be positioned and adhered to the conductor means 114. Similarly, bottom surface 150 has a segmented conductor having segmented conductor segments 154, 156, 158, 160 that may be positioned and adhered to the conductor means 152. The segments are each spaced apart a preselected distance as shown in FIGS. 6 and 7. Notably, the distances may be different (not illustrated); or they may be selected to be substantially the same as shown in FIGS. 6 and 7, as desired by the user. The segments are positioned on the conductive ink 114, 152 to regulate the conductivity and in turn the electrical resistance of the conductive ink 114, 152 as more specifically discussed hereinafter.

It may also be noted that the segmented conductor is adhered to the conductive ink and in turn has a thickness which is from about 0.007 millimeters to about 0.015 millimeters and preferably about 0.011 millimeters. Each segment 116, 118, 120, 122 has a length selected to regulate the electrical resistivity of the bi-directional deflective resistor as discussed hereinafter.

Figure 8:
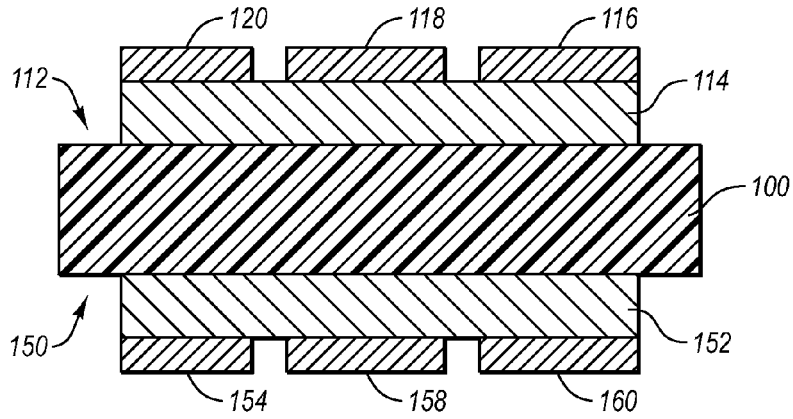
FIG. 8 is a substantially enlarged cross-section view of a portion of a deflectable resistor in a static position.
Figure 9:
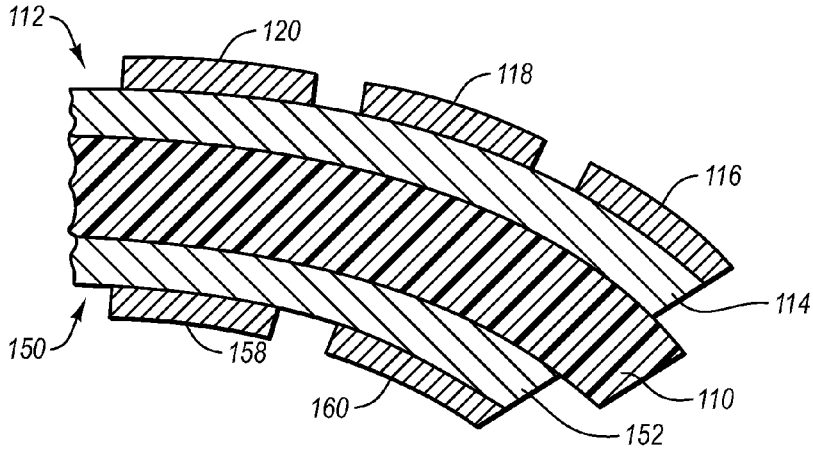
FIG. 9 is a substantially enlarged cross-section view of a portion of a deflectable resistor deflected in a first direction.
Figure 10:
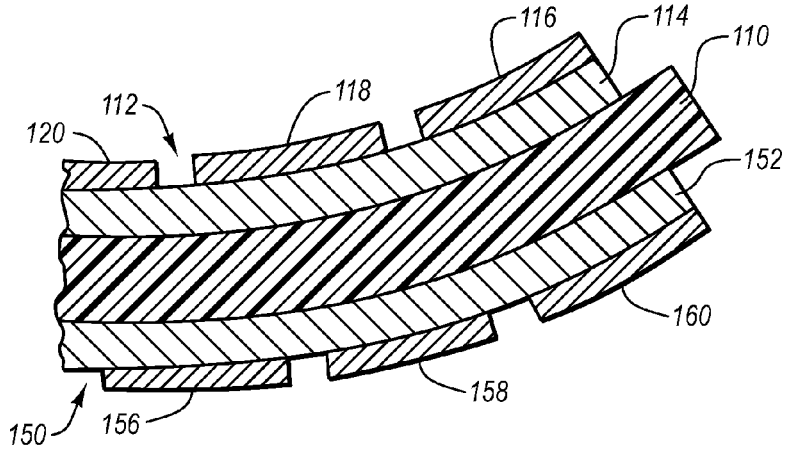
FIG. 10 is a substantially enlarged cross-section view of a portion of a deflectable resistor deflected in a second direction that is different than the first direction of FIG. 9.

In FIGS. 8, 9 and 10, a portion of the bi-directional deflectable resistor is shown in a first static or non-deflected configuration A (FIG. 8) and in a second bent configuration D (FIG. 9) and a third bent configuration B (FIG. 10). The electrical resistance of the deflectable resistor consistently, predictably varies as the substrate 100 is bent or deflected incrementally to any configuration between configuration A, B and D as well as other configurations involving greater bending or deflection.

As the bi-directional deflectable resistor is deflected or bent, it is believed that micro-cracks added during manufacturing to the conductive ink which contains graphite, separate and widen. That is, the dried conductive ink 114, 152 has a granular or crystalline-type structure with micro-cracks that separate or open up upon deflection. As the conductive ink 114, 152 bends, the space between the micro-cracks increases, thereby changing the electrical resistance in a predictable manner. As the resistor is bent, the change can be measured upon application of suitable electrical signals.

The segmented conductor 116, 118, 120 is positioned along the conductive ink 114 on top surface 112 and segmented conductor 154, 158, 160 is positioned along the conductive ink 152 on bottom surface 150 in pre-selected lengths to control or regulate the resistivity of the deflected conductive ink 114, 152 and in turn ensure that upon repetitive deflections, the variation of the resistance between configurations A, B and D is consistent throughout the life of the substrate. For example, if the width is the same as the width of the conductor means 114, 152, a length of about 3 to about 5 millimeters with spacing from about 1 to about 2 millimeters has been found suitable for a deflectable resistor 10 similar to that of FIG. 1 with a length of about 10 centimeters and a width of about two centimeters.

The segmented conductor 116, 118, 120, 154, 158, 160 has been successfully formed of silver. It is also believed formable from conductive silver alloys, and other conductive metals, as well as carbon-based compounds. The segmented conductor 116, 118, 120, 154, 158, 160 retains its electrical conductivity upon deflection.

With the segmented conductor 116, 118, 120 affixed or adhered to the conductor means 114 and segmented conductor 154, 158, 160 affixed or adhered to the conductor means 152, the resistance may still vary somewhat over time, but the degree of variance is either within acceptable tolerances or otherwise measurable from time to time so that adjustments can be made to accommodate for the drift in resistance over time.

Figure 11:
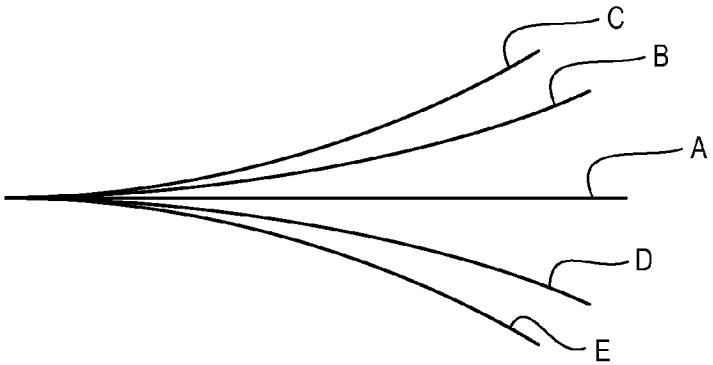
FIG. 11 is a side view of a deflectable resistor in various degrees of deflection.

Bi-directional deflectable resistor 10 generates a substantial change in resistance when deflected in both a first direction from a generally straight position and in a second direction that is in an opposite direction from a generally straight position. For example, FIG. 11 shows a side view of a deflectable resistor 10 at various degrees of deflection, denoted A, B, C, D and E. Deflectable resistor 10 is a bi-directional deflectable resistor having a substrate on which at least one layer of variable resistance material is applied on the top surface and the bottom surface. Degrees of deflection B and C are in a first direction and degrees of deflection D and E are in a second direction.

Generally speaking, position A is a static position that is substantially flat or straight relative to an imaginary x-y axis, where the longitudinal y-axis extends the length of deflectable resistor 10 and the x-axis extends upward and downward relative to the top and bottom surface of deflectable resistor 10. Accordingly, the deflection of deflectable resistor 10 moves in a direction relative to this longitudinal y-axis, and hence the top and bottom surface of deflectable resistor 10, in either a positive x-direction or a negative x-direction. In the illustrated example, deflection degrees B and C are in a positive x-direction, generally upward and away from relative to the top surface, and deflection degrees D and E are in a negative x-direction, generally downward and away from relative to the bottom surface and opposite the positive x-direction, both the positive x-direction and the negative x-direction being relative to the imaginary longitudinal y-axis extending along the length of the substrate of deflectable resistor 10.

At deflection degree A, which is straight, deflectable resistor 10 has a resistance $R_A$. At deflection degree B, deflectable resistor 10 has a resistance $R_B$, which is substantially greater than resistance $R_A$. At deflection degree B, the level of resistance $R_B$ is predictable and repeatable. At deflection degree C, deflectable resistor 10 has a resistance $R_C$, which is substantially greater than resistance $R_B$ and is predictable and repeatable. Accordingly, as the deflection changes from degree C to degree B, there is a predictable and repeatable decrease in resistance. At deflection degree D, deflectable resistor 10 has a resistance $R_D$, which is substantially greater than resistance $R_A$. At deflection degree D, the level of resistance $R_D$ is predictable and repeatable. At deflection degree E, deflectable resistor 10 has a resistance $R_E$, which is substantially greater than resistance $R_D$ and is predictable and repeatable. Accordingly, as the deflection changes from degree E to degree D, there is a predictable and repeatable decrease in resistance.

Figure 12:
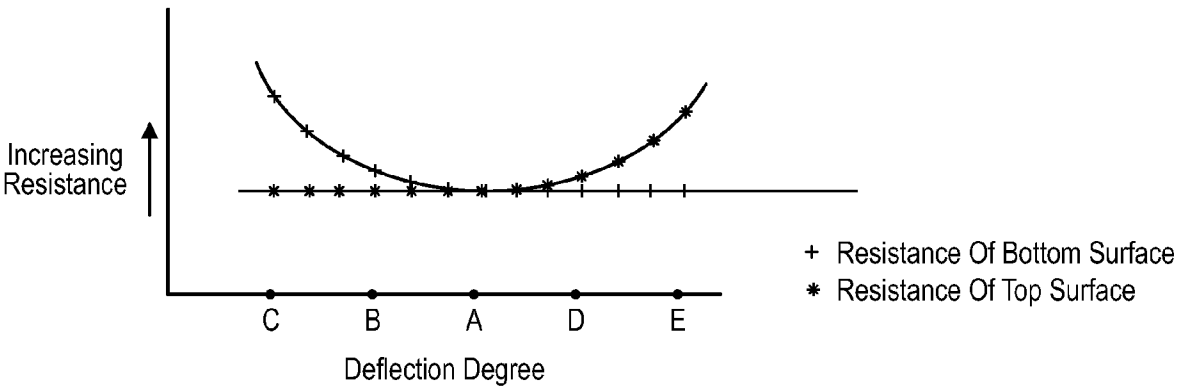
FIG. 12 shows a graph illustrating the correlation between resistance and deflection degrees illustrated in FIG. 11 for a first layer of conductive material on the top surface and a second layer of conductive material on the bottom surface of bi-directional deflectable resistor.

FIG. 12 shows a graph illustrating the correlation between resistance and deflection degrees illustrated and explained with respect to FIG. 11 for the first layer of conductive material on the top surface and the second layer of conductive material on the bottom surface of bi-directional deflectable resistor 10. At deflection degree E, the resistance of the first layer of conductive material on the top side has increased predictably from static deflection degree A, whereas the resistance of the second layer of conductive material on the bottom side is very nearly equal to the resistance of the second layer of conductive material on the bottom side at the static deflection degree A. At deflection degree D, the resistance of the first layer of conductive material on the top side has increased predictably from static deflection degree A to a lesser extent than deflection degree E, whereas the resistance of the second layer of conductive material on the bottom side remains very nearly equal to the resistance of the second layer of conductive material on the bottom side at the static deflection degree A.

Continuing with the FIG. 12 graph, it is shown that at deflection degree C, the opposite is true. The resistance of the second layer of conductive material on the bottom side has increased predictably from static deflection degree A, whereas the resistance of the first layer of conductive material on the top side is very nearly equal to the resistance of the first layer of conductive material on the top side at the static deflection degree A. At deflection degree B, the resistance of the second layer of conductive material on the bottom side has increased predictably from static deflection degree A to a lesser extent than deflection degree C, whereas the resistance of the first layer of conductive material on the top side is very nearly equal to the resistance of the first layer of conductive material on the top side at the static deflection degree A.

Figure 14:
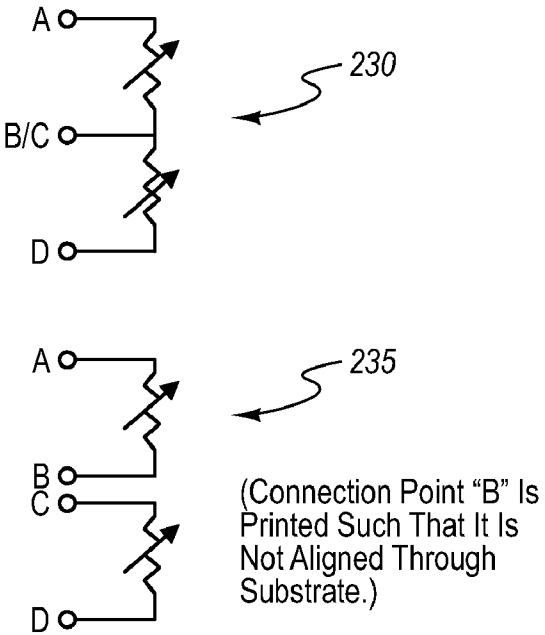
FIG. 14 illustrates potential electrical connections of the preferred embodiment of a physical configuration of a bi-directional deflectable resistor in FIG. 13.
Figure 13:
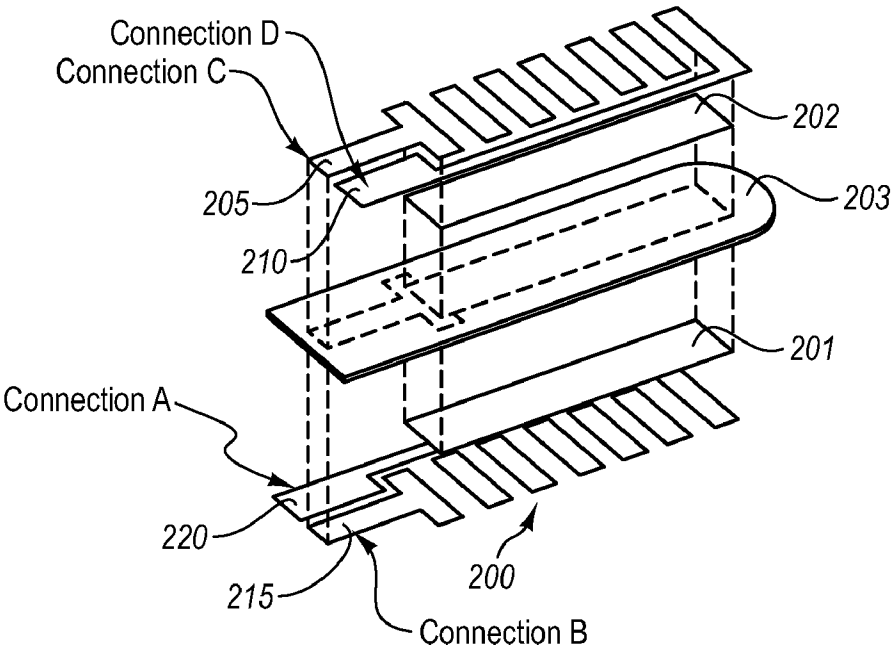
FIG. 13 illustrate a preferred embodiment of a physical configuration of a bi-directional deflectable resistor.

FIGS. 13 and 14 illustrate a preferred embodiment of a physical configuration of a bi-directional deflectable resistor 200 and possible electrical connections 230, 235. Deflectable resistor 200 comprises a first layer of conductive ink 202 disposed on the top surface of substrate 203 and a second layer of conductive ink disposed on the bottom surface of substrate 203. The top surface of substrate 203 has a first top segmented conductor 205 positioned on the first layer of conductive ink 202 and a second top segmented conductor 210 electrically connected to the first layer of conductive ink 202 and printed on the top surface of substrate 203. First top segmented conductor 205 and second top segmented conductor 210 are configured to be connectable to a connector for measuring the resistance of the first layer of conductive ink 210.

The bottom surface of substrate 203 has a first bottom segmented conductor 215 positioned on the second layer of conductive ink 202 and a second bottom segmented conductor 220 electrically connected to the first layer of conductive ink 202 and printed on the top surface of substrate 203. First bottom segmented conductor 205 and second bottom segmented conductor 210 are configured to be connectable to a connector for measuring the resistance of the second layer of conductive ink 210.

As shown in FIG. 14, electrical configuration 230 represents a physical configuration embodiment in which connection point B is aligned through substrate 203 and electrically connected to connection point C. The resulting electrical configuration 230 has a top surface resistance and a bottom surface resistance that may be measured in reference to a common connection point B/C. In the alternative, electrical configuration 235 represents a physical configuration embodiment in which connection point B is not aligned through substrate 203 and is therefore not electrically connected to connection point C. The resulting electrical configuration 235 has a top surface resistance and a bottom surface resistance that may be measured independently since there is no electrical connection between connection point B and connection point C.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A bi-directional deflectable resistor comprising:

a substrate having a top surface and a bottom surface and a first configuration, said substrate being bendable to a second configuration relative to said first configuration in a direction away from relative to said top surface, said substrate being bendable to a third configuration relative to said first configuration in a direction away from relative to said bottom surface and opposite to said direction away from relative to said top surface;

a first layer of conductive material disposed on said top surface, said first layer of conductive material having a resistance that changes predictably when an electrical signal is applied thereto, said change of resistance of said first layer of conductive material reflects an amount of deflection between said first configuration and said second configuration; and a second layer of conductive material disposed on said boffom surface, said second layer of conductive material having a resistance that changes predictably when an electrical signal is applied thereto, said change of resistance of said second layer of conductive material reflects an amount of deflection between said first configuration and said third configuration.

2. The bi-directional deflectable resistor of claim 1 wherein said first configuration is a static configuration.

3. The bi-directional deflectable resistor of claim 2 wherein said static configuration is a substantially flat substrate.

4. The bi-directional deflectable resistor of claim 2 wherein said static configuration is one where said substrate has at least one bend.

5. The bi-directional deflectable resistor of claim 1 wherein said first layer of conductive material is an ink and said second layer of conductive material is an ink.

6. The bi-directional deflectable resistor of claim 1 wherein a bending of said first layer of conductive material between said first configuration and said second configuration widens a number of cracks in said first layer of conductive material.

7. The bi-directional deflectable resistor of claim 6 wherein a bending of said second layer of conductive material between said first configuration and said third configuration widens a number of cracks in said second layer of conductive material.

8. The bi-directional deflectable resistor of claim 7 wherein said width of cracks in said first layer of conductive material increases and said resistance increases as the bending to said second configuration increases.

9. The bi-directional deflectable resistor of claim 8 wherein said width of cracks in said second layer of conductive material increases and said resistance increases as the bending to said third configuration increases.

10. The bi-directional deflectable resistor of claim 9 wherein the number of cracks in said first layer of conductive material and said second layer of conductive material become wider and the resistance increases as the bending to said first configuration and second configuration increases.

11. The bi-directional deflectable resistor of claim 1 further comprising:

a first connector means coupled to said first layer of conductive material for interconnection to external electrical components; and a second connector means coupled to said second layer of conductive material for interconnection to external electrical components.

12. A bi-directional deflectable resistor comprising:

a substrate having a first surface and a second surface spaced from and essentially opposite said first surface, said substrate being bendable in a first direction away from relative to said first surface, said substrate being bendable in a second direction away from and relative to said second surface and essentially opposite said first direction;

a first layer of electrically conductive ink on said first surface of said substrate, said first layer of electrically conductive ink having a resistance that changes predictably when an electrical signal is applied thereto, said change of resistance of said first layer of electrically conductive ink reflects the amount of deflection in said first direction; and a second layer of electrically conductive ink on said second surface of said substrate, said second layer of electrically conductive ink having a resistance that changes predictably when an electrical signal is applied thereto, said change of resistance of said second layer of electrically conductive ink reflects the amount of deflection in said second direction.

13. The bi-directional deflectable resistor of claim 12, wherein said substrate has a length with a longitudinal y-axis running along said length and wherein said first direction is in a positive x direction relative to said longitudinal y-axis and said second direction is in a negative x direction relative to said longitudinal y-axis.

14. The bi-directional deflectable resistor of claim 13 wherein said longitudinal y-axis occurs when said substrate is in a static position.

15. The bi-directional deflectable resistor of claim 14 wherein said static position is a substantially flat substrate.

16. The bi-directional deflectable resistor of claim 12, further comprising:

a first segmented conductor positioned on said first layer of electrically conductive ink, said first segmented conductor being formed of an electrically conductive material deposited on said first layer of electrically conductive ink in spaced apart segments; and a second segmented conductor positioned on said second layer of electrically conductive ink, said second segmented conductor being formed of an electrically conductive material deposited on said second layer of electrically conductive ink in spaced apart segments.

17. The bi-directional deflectable resistor of claim 16 wherein said first layer of electrically conductive ink has a width, wherein said first segmented conductor has a plurality of segments each having a width substantially the width of said first layer of electrically conductive ink and a length selected to regulate said resistance of said first layer of electrically conductive ink.

18. The bi-directional deflectable resistor of claim 17 wherein said second layer of electrically conductive ink has a width, wherein said second segmented conductor has a plurality of segments each having a width substantially the width of said second layer of electrically conductive ink and a length selected to regulate said resistance of said second layer of electrically conductive ink.

19. The bi-directional deflectable resistor of claim 18 wherein said first and second segmented conductors are made of a soft conductive metal.

20. The bi-directional deflectable resistor of claim 19 wherein said first and second segmented conductors are made of silver or a silver alloy.

21. The bi-directional deflectable resistor of claim 18 wherein said first and second segmented conductors are made of carbon or a carbon compound.

22. The bi-directional deflectable resistor of claim 12 further comprising:

a first connector means coupled to said first layer of conductive material for interconnection to external electrical components; and a second connector means coupled to said second layer of conductive material for interconnection to external electrical components.

23. A bi-directional deflectable resistor comprising:

a substrate having a top surface and a bottom surface, said substrate having a first configuration, said substrate being bendable in a second configuration relative to said first configuration in a direction away from relative to said top surface, said substrate being bendable in a third configuration relative to said first configuration in a direction away from relative to said bottom surface and opposite said direction away from relative to said top surface;

a first conductor means adhered to said top, surface of said substrate for predictably measuring the amount of deflection from said first configuration to said second configuration, said first conductor means able to bend with said substrate, said first conductor means having a resistance that changes predictably to reflect an amount of deflection between said first configuration and said second configuration;

a second conductor means adhered to said bottom surface of said substrate for predictably measuring the amount of deflection from said first configuration to said third configuration, said second conductor means able to bend with said substrate, said second conductor means having a resistance that changes predictably to reflect an amount of deflection between said first configuration and said third configuration;

a first connector means coupled to said first conductor means for interconnection to external electrical components; and a second connector means coupled to said second conductor means for interconnection to external electrical components.

24. A method for varying the resistance in an electrical circuit comprising:

providing a substrate formed of a deflectable electrical insulating material, said substrate having a top surface and a bottom surface and a first configuration, said substrate being bendable in a first direction relative to said top surface from said first configuration to a second configuration, said substrate being bendable in a second direction relative to said bottom surface and opposite said first direction from said first configuration to a second configuration;

providing a first layer of conductive material disposed on said top surface for conducting electricity as part of an electrical circuit, said first layer of conductive material having a resistance that changes predictably when an electrical signal is applied thereto, said change of resistance of said first layer of conductive material reflects an amount of deflection between said first configuration and said second configuration; providing a second layer of conductive material disposed on said bottom surface for conducting electricity as part of an electrical circuit, said second layer of conductive material having a resistance that changes predictably when an electrical signal is applied thereto, said change of resistance of said second layer of conductive material reflects an amount of deflection between said first configuration and said third configuration;

providing a connector means for connection to external electrical components;

connecting said connector means to said first layer of conductive material, said second layer of conductive material and said external electrical components in said electrical circuit;

bending said substrate and said first layer of conductive material between a first position and a second position;

applying an electrical signal to said first layer of conductive material; and measuring a change of resistance of said first layer of conductive material to determine an amount of deflection between said first configuration and said second configuration.

25. The method of claim 24 further comprising:

bending said substrate and said second layer of conductive material between a first position and a third position;

applying an electrical signal to said second layer of conductive material; and measuring a change of resistance of said second layer of conductive material to determine an amount of deflection between said first configuration and said third configuration.

26. A bi-directional deflectable resistor comprising:

a substrate having a top surface and a bottom surface, said substrate being bendable in a first direction away from relative to said top surface, said substrate being bendable in a second direction away from and relative to said bottom surface and opposite said first direction;

a first layer of electrically conductive ink on said top surface of said substrate, said first layer of electrically conductive ink having a resistance that changes predictably when an electrical signal is applied thereto, said change of resistance of said first layer of electrically conductive ink reflects the amount of deflection in said first direction;

a second layer of electrically conductive ink on said bottom surface of said substrate, said second layer of electrically conductive ink having a resistance that changes predictably when an electrical signal is applied thereto, said change of resistance of said second layer of electrically conductive ink reflects the amount of deflection in said second direction;

a first segmented conductor positioned on said first layer of electrically conductive ink, said first segmented conductor being formed of an electrically conductive material deposited on said first layer of electrically conductive ink in spaced apart segments; and a second segmented conductor positioned on said second layer of electrically conductive ink, said second segmented conductor being formed of an electrically conductive material deposited on said second layer of electrically conductive ink in spaced apart segments.

* * * * *